United States Patent [19]

Lisiecki

[11] 4,211,357

[45] Jul. 8, 1980

[54] CONTAINER AND BLANK FOR CONSTRUCTING SAME

[75] Inventor: Robert E. Lisiecki, Orchard Lake, Mich.

[73] Assignee: Ex-Cell-O Corporation, Troy, Mich.

[21] Appl. No.: 957,393

[22] Filed: Nov. 3, 1978

Related U.S. Application Data

[63] Continuation-in-part of Ser. No. 755,404, Dec. 29, 1976, abandoned.

[51] Int. Cl.[2] ..... B65D 5/72

[52] U.S. Cl. ..... 229/17 G

[58] Field of Search ..... 229/17 G, 17 R

[56] References Cited

U.S. PATENT DOCUMENTS

| | | | |
|---|---|---|---|
| 2,682,208 | 6/1954 | Monroe et al. | 93/36 |
| 3,116,002 | 12/1963 | Crawford et al. | 229/17 G |
| 3,120,335 | 2/1964 | Egleston et al. | 229/17 G |
| 3,125,274 | 3/1964 | Zinn | 229/17 G X |
| 3,164,315 | 1/1965 | Kelly | 229/17 G |
| 3,270,940 | 9/1966 | Egleston et al. | 229/17 G |
| 3,355,083 | 11/1967 | Wilcox | 229/17 G |
| 3,731,600 | 5/1973 | Earp | 93/58.1 |
| 3,869,078 | 3/1975 | Braun | 229/17 R |
| 3,892,347 | 7/1975 | Egleston | 229/17 R |
| 4,012,997 | 3/1977 | Bachner et al. | 93/36.8 |
| 4,078,715 | 3/1978 | Larsson et al. | 229/17 R |
| 4,085,885 | 4/1978 | Lisiecki et al. | 229/17 R |
| 4,093,115 | 6/1978 | Bachner et al. | 229/17 G |

FOREIGN PATENT DOCUMENTS

| | | | |
|---|---|---|---|
| 1289481 | 2/1969 | Fed. Rep. of Germany | 229/17 G |
| 108758 | 6/1964 | Netherlands | 229/17 G |
| 472324 | 6/1969 | Switzerland | 229/17 G |

*Primary Examiner*—Davis T. Moorhead

*Attorney, Agent, or Firm*—Reising, Ethington, Barnard, Perry & Brooks

[57] ABSTRACT

A coated paperboard container and a blank for constructing the container is disclosed as including a body portion having an upper end that is closed by a folded top end closure which includes closure panels and seal lips having a construction that enhances foldability and sealing. Front and back gable panels of the top end closure are each flanked by a pair of triangular inner roof panels that have different sizes than each other so as to facilitate folding of a top seal provided by the seal lips from a vertical position in a direction toward the smaller inner roof panels. Inner seal lips are each connected to one pair of the inner roof panels by a single score line and outer seal lips are likewise each connected to outer roof panels of the closure by a single score line. Terminal edges of the outer seal lips extend alongside each other in the constructed condition. The unequal size of the inner roof panels on opposite sides of each gable panel is provided in the preferred embodiments by unequal base angles on the gable panels or by inclined score line portions that connect the smaller inner roof panels and the inner seal lips. The inclined score line portions and the score line between the outer seal lip and the outer roof panel adjacent the smaller inner roof panels are wider than the other score lines so as to allow the top seal to be sealed in a vertical position and then folded toward the smaller inner roof panels.

26 Claims, 18 Drawing Figures

CONTAINER AND BLANK FOR CONSTRUCTING SAME

This application is a continuation-in-part of copending application Ser. No. 755,404, filed Dec. 29, 1976, now abandoned and assigned to the assignee of the present invention, and the entire disclosure of this earlier parent application is hereby incorporated by reference.

TECHNICAL FIELD

This present invention relates to a coated paperboard container and to a blank for constructing the container so as to include a body portion having a top end closed by a folded top end closure of an improved construction.

BACKGROUND ART

Containers for beverages such as milk, cream, other dairy products, juices, and the like are conventionally constructed from thermoplastic coated paperboard. One type of these containers includes a top end closure with a folded gable roof having a vertically projecting seal at the roof ridge for sealing the container and providing a pouring spout when the contents of the container are to be dispensed. Stacking of such containers requires the use of separating trays intermediate different layers due to the vertically projecting seals of their top end closures. Also, storage space is lost in stacking these containers due to the empty space resulting from the configuration of the top end closure. Such containers are shown by U.S. Pat. Nos. 3,116,002 and 3,120,335. Another type of the containers include flat top end closures that are folded and have a flat seal projecting from a centerline of the closure with an outer end that is releasably secured to the rest of the closure generally adjacent one of its sides. Various releasable securements are provided for releasing the flat seals to permit them to be opened and to thereby provide a pouring spout for dispensing the beverages. U.S. Pat. Nos. 3,869,078 and 3,892,347 disclose such flat top end closures. A further type of container is disclosed by U.S. Published Patent application No. B461,257, published Jan. 13, 1976, now U.S. Pat. No. 4,078,715, issued Mar. 14, 1978, and includes a top end closure with an inclined seal that includes a harder score line on one side of the seal for facilitating folding of the seal from a vertical position to the inclined position.

U.S. Pat. Nos. 4,012,997 and 4,093,115 disclose a container folding method and the container made by the method wherein certain roof panels of the top end closure are provided with double score lines extending alongside each other. Folding of a top seal of the end closure from a vertical position to a flat position requires the application of a downward force along the lower double score line on one side of the top seal and the application of another force to bend the top seal downwardly. Each additional application of force for folding the top end closure requires an additional folding tool on the folding mechanism and is thus accompanied by additional expense.

Coated paperboard blanks for constructing each type of container described above are made on converting machines like those disclosed by U.S. Pat. Nos. 2,682,208 and 3,731,600. After construction of the blanks to form the containers, application of heat or high frequency vibration applied by clamping pressure to interengaged portions of the blanks provides sealing of the containers.

DISCLOSURE OF THE INVENTION

An object of the present invention is to provide an improved coated paperboard container and a blank for constructing the container to include a top end closure comprised of a folded roof and a top seal for sealing the roof, and wherein the construction of the top end closure enhances foldability of the top seal from a vertical position.

In carrying out the above object and other objects of the invention, different embodiments of the blank from which the container is constructed each include a pair of triangular gable panels whose opposite sides are connected to a pair of triangular inner roof panels that are of a different size than each other. An inner seal lip associated with each pair of inner roof panels is connected thereto by an associated single score line. A pair of outer roof panels of the top end closure are likewise connected to associated outer seal lips by associated single score lines. Folding of the top seal which is defined by the inner and outer seal lips is facilitated in a direction toward the smaller inner roof panels so as to enable the top closure to be constructed into a slant top closure or a flat top closure. The closure can also be constructed as a straight up closure without any folding of the top seal. Terminal edges of the outer seal lips extend alongside each other after construction of the top end closure and the inner seal lips are folded during each construction so that terminal edge portions of each inner seal lip extend parallel to each other inwardly from the terminal edges of the outer seal lips.

Each embodiment of the container is constructed from a coated paperboard blank so as to include a body portion having a pair of side panels connected by front and back panels. As disclosed, the back panel is secured to one of the side panels by a seam flap with a heat bond during construction of the container. A bottom end of the constructed container includes a bottom end closure that closes the lower side of the container body portion while folded closure panels and seal lips at the upper end of the container body portion form the folded roof and the top seal of the invention.

In certain preferred embodiments, the outer roof panels of the roof extend upwardly from the side panels at inclined orientations and cooperatively define a roof ridge from which the top seal projects upwardly and laterally at an inclined orientation so as to provide a slant top seal. The triangular front and back gable panels are connected to the front and back panels and are connected to the outer roof panels by the associated pairs of inner roof panels. Each gable panel has inclined edges that intersect with each other at an apex of the gable panel. One inclined edge of each gable panel on the side of the roof ridge toward which the seal projects defines an angle with the associated front or back panel that is just slightly larger than the angle defined by the inclined edge on the other side of the roof ridge. The inclined edges of the gable panels thus define unequal base angles and thereby provide the inner roof panels on one side of the constructed container with a smaller size than the inner roof panels on the other side of the container. This construction of the container blank facilitates assembly of the roof and the slant top seal with the seal projecting at its inclined orientation closing the container. Triangular spout portions of the outer roof panels cooperate with the inner roof panels and the front triangular gable panel to provide a pouring spout when the container is opened.

Outer seal lips of the slant top seal project from the inclined outer roof panels and have straight terminal edges that are sealed to each other. The outer seal lip and the outer roof panel connected thereto on the side of the roof ridge toward which the slant top seal extends have a combined height projecting from the associated body portion side panel a shorter distance than the outer seal lip and outer roof panel on the other side of the roof ridge. As such, both terminal edges of the outer seal lips are located adjacent each other without the lower one projecting beyond the upper one. In one construction, the difference in the combined height of the outer roof panel and seal lip on each side of the roof ridge is provided by the distance the outer seal lips project from outer roof panels of equal heights. In another construction, this combined height difference is provided by having the outer roof panel toward which the slant top seal extends projecting from its associated body portion side panel a shorter distance than the other outer roof panel. Thus, the single score line which connects the shorter outer roof panel and its associated outer seal lip is lower or dropped relative to the apices of the gable panels and the corresponding score line on the other side of the constructed seal.

Front and back inner seal lips of the slant top seal respectively project from the inner roof panels connected to the triangular gable panels. Each inner seal lip is folded during construction and is located between the outer seal lips, with the front inner seal lip located along the roof ridge adjacent the front panel of the body portion, and with the back inner seal lip located along the roof ridge adjacent the back panel of the body portion. Opposite ends of the inner seal lips are connected to the outer seal lips with the container constructed in its sealed condition.

Each inner seal lip of the slant top seal has an unsymmetrical V-shaped terminal edge. The end of each inner seal lip connected to the upper outer seal lip projects from its associated inner roof panel a greater distance than the other end of the inner seal lip so that the folded inner seal lips have their terminal edges located adjacent each other extending parallel to the straight terminal edges of the outer seal lips in a manner that lessens the likelihood of leakage with the slant top seal in its inclined orientation. Heat or high frequency vibration bonding secure the outer seal lip edges to each other and also seal the outer seal lips to the inner seal lips along the seal portion adjacent the back panel of the body portion. An abhesive coating applied to the outer seal lips and the front inner seal lip prevents complete bonding therebetween so as to facilitate opening of the pouring spout. Front portions of the outer seal lips and the front inner seal lip cooperate with the front gable panel and the inner roof panels connected thereto to define the pouring spout used to dispense the contents of the container.

In one slant top embodiment of the container, each front and back inner seal lip has a score extending from the vertex of its V-shaped terminal edge to the intersection between the inclined edges of the associated triangular gable panel. Another slant top embodiment has each of its front and back inner seal lips provided with a score centered midway between its opposite ends in a spaced relationship to the intersection of the associated gable panel inclined edges. A pair of scores are provided on each inner seal lip in a further slant top embodiment, one of the scores intersecting with the intersection of the associated gable panel inclined edges, and the other score being centered midway between the opposite inner seal lip ends. A relatively wide score is provided on each inner seal lip of a still further slant top embodiment with the width of each score extending between the midpoint intermediate the opposite ends of the inner seal lip and a line that extends through the intersection between the inclined edges of the associated gable panel. The latter three embodiments are especially useful in constructing relatively large containers.

Deflection of the slant top seals during stacking provides a cushioning effect between different layers of the stacked containers. Good sealing without leakage is achieved despite the deflection due to the foldability of the top end closure and the construction of the slant top seal with its outer seal lips terminating adjacent each other as do the folded inner seal lips between the outer lips.

Another preferred embodiment of a blank for constructing a container in accordance with the present invention includes a single score line that connects one of the outer seal panels and the associated outer roof panel at a lower elevation than the apices of the front and back gable panel, and each single score line between the inner seal lips and the associated pair of inner roof panels thereof includes an inclined score line portion. Upper ends of the inclined score line portions intersect with the apices of the associated gable panels and lower ends of the inclined score line portions are located adjacent the opposite ends of the dropped score line in the constructed condition of the top end closure formed by the blank. The inner roof panels on one side of the top seal of the constructed end closure are of a smaller size than the inner roof panels on the other side of the top seal. Sealing of the top seal is performed with the inner and outer seal lips located in a generally vertical position. Each of the inclined score line portions between the smaller triangular inner roof panels and their associated inner seal lips and the dropped score line between the one outer seal lip and its associated outer roof panel are preferably wider than the other score lines of the top end closure. This construction of the container blank facilitates folding of the top seal from the vertical position to either an inclined position for providing a slant top or a horizontal position where the top seal is adhesively bonded to the adjacent outer roof panel to provide a flat top end closure. Regardless of whether the top seal is used to make a vertical top, a slant top, or a flat top end closure, the terminal edges of the outer seal lips extend alongside each other and the folded inner seal lips have their terminal edges likewise extending alongside each other located inwardly from the terminal edges of the outer seal lips.

In the preferred construction of the blank having the dropped score line and inclined score line portions that are wider than the other score lines of the top end closure, the outer seal lip and outer roof panel connected by the dropped score line are located between the two smaller triangular inner roof panels in the flat condition of the blank prior to construction. A seam flap that connects the other outer roof panel and one of the larger inner roof panels is thus located on the opposite side of the top seal from the smaller inner roof panels toward which the top seal is capable of being bent. Such an arrangement of the top seal panels and seal lips enhances the seal provided by the container blank.

Each of the container embodiments may have one of two different "abhesive" coating patterns applied to its seal lips. An "abhesive" coating is a term used by those who work in the container art to describe any suitable material, such as a wax based material, that prevents sealing between different portions of the container. Both of the abhesive patterns utilized have the abhesive coating applied to the front inner seal lip along its length but terminating just short of its opposite ends. One pattern has the abhesive coating on the outer seal lips terminating so as not to cover the front inner seal lip along the score line or lines thereof with the seal closed. The other abhesive pattern has the abhesive coating on the outer seal lips covering the score line or lines of the front inner seal lip.

The objects, features and advantages of the present invention are readily apparent from the following description of the best mode for carrying out the invention when taken in connection with the accompanying drawings.

BEST MODE FOR CARRYING OUT THE INVENTION

Figure 1:
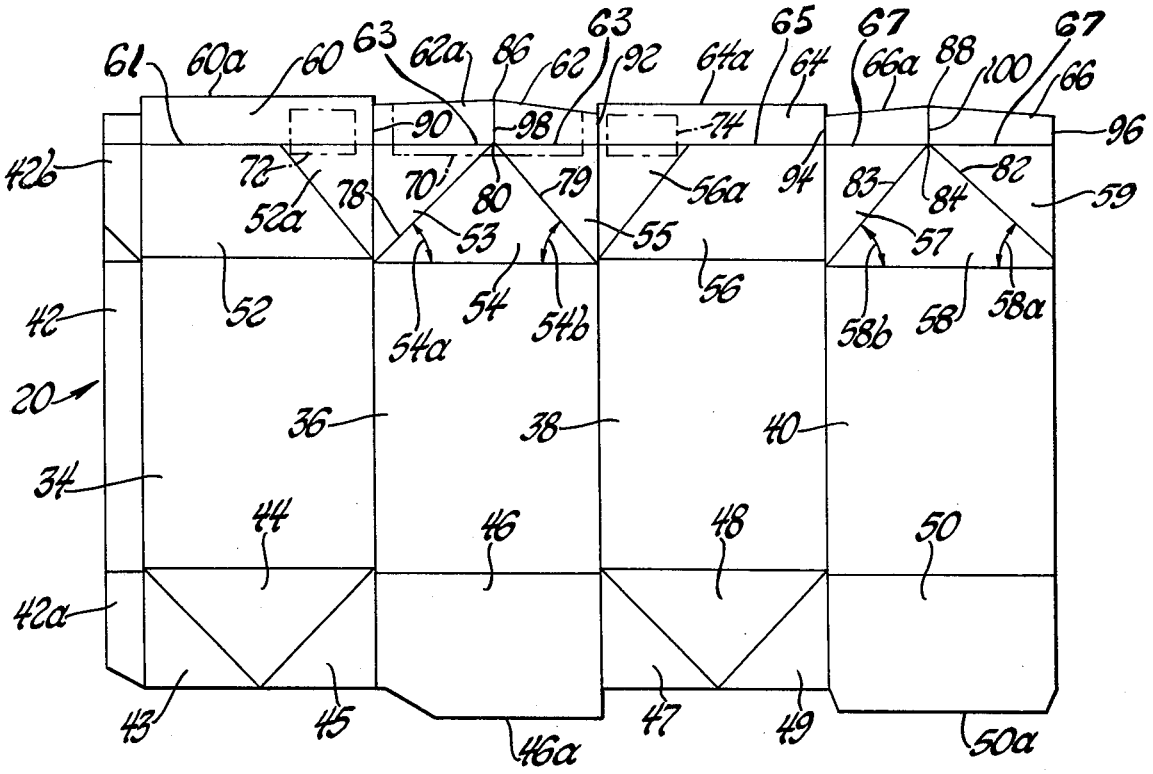
FIG. 1 is a view of one preferred embodiment of a coated paperboard container blank used to construct a container having a top end closure with a roof and a top seal in accordance with the present invention.
Figure 2:
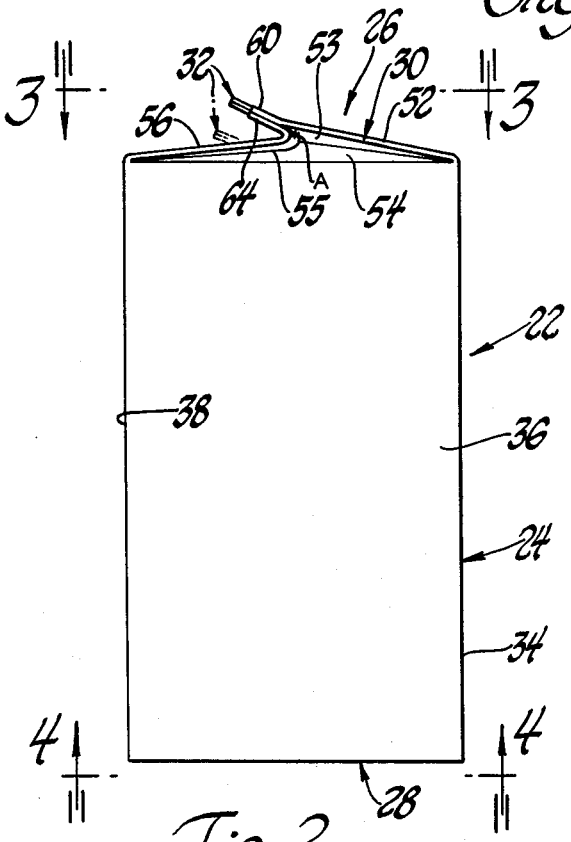
FIG. 2 is a front elevation view of a container constructed from the container blank shown in FIG. 1.
Figure 3:
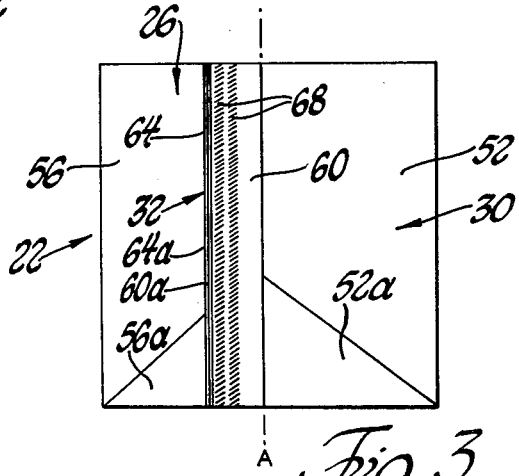
FIG. 3 is a top plan view taken along line 3—3 of FIG. 2 showing the top end closure of the container.
Figure 4:
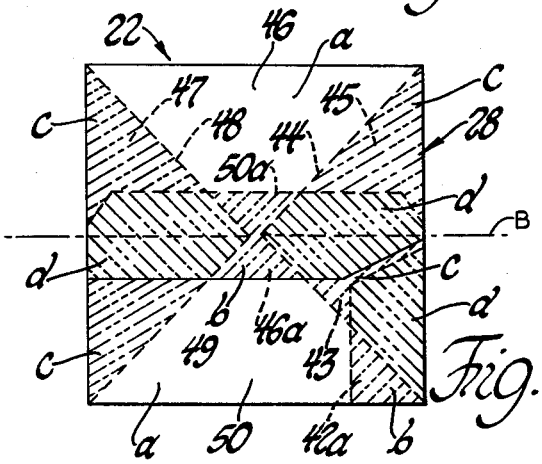
FIG. 4 is a bottom plan view taken along line 4—4 of FIG. 2 showing a bottom end closure of the constructed container.
Figure 5:
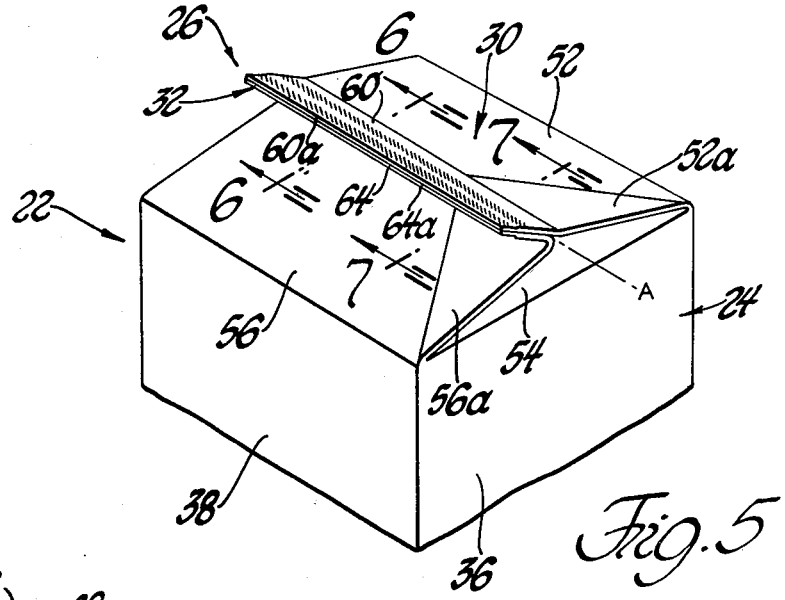
FIG. 5 is a perspective view showing the top end closure of the container shown in FIG. 2 with the closure in a closed and sealed condition.

A thermoplastic coated paperboard blank indicated by reference numeral 20 in FIG. 1 is constructed according to one preferred embodiment of the invention to provide a carton or container 22 as shown in FIG. 2. A tubular body portion 24 of container 22 has a top end closed by a slant top end closure 26 of the invention and also has a bottom end closed by a bottom end closure 28. As can be seen in FIGS. 3 and 5 in addition to FIG. 2, the slant top end closure 26 includes a folded gable roof 30 at the top end of the container with a slant top seal 32 projecting laterally and upwardly at an inclined orientation from a roof ridge axis A. Bottom end closure 28 has a square configuration as shown in FIG. 4 for closing the bottom end of the container body portion 24.

Container blank 20 as shown in FIG. 1 includes various scores or score lines along which the blank is folded to provide the container body portion 24, the slant top end closure 26, and the bottom end closure 28. Intermediate its upper and lower ends, blank 20 includes a rectangular side panel 34 connected to a rectangular front panel 36 which is itself connected to another rectangular side panel 38. A rectangular back panel 40 is also connected to the side panel 38 and is secured to a seam flap 42 connected to the side panel 34 during construction of the container in order to form a tubular configuration. Securement of the seam flap 42 to the back panel 40 is provided by heat with a clamping pressure utilized to bond the thermoplastic coating of the container blank portions to each other.

Bottom end closure 28 is formed after the construction of the container blank into its tubular shape by folding the various triangular and rectangular panels 43, 44, 45, 46, 47, 48, 49 and 50 and then bonding these panels to each other. A lower end 42*a* of seam flap 42 is secured to the panel 50 during the formation of the container blank into its tubular configuration. Inward folding of the triangular panels 44 and 48 toward each other then pulls the triangular panels 43, 45 and 47, 49 connected thereto into an overlying relationship therewith as the rectangular panels 46 and 50 are concomitantly pulled inwardly to overlie the triangular panels in a generally planar relationship to form the end closure. End closure 28, as can be seen in FIG. 4, is of the tucked in type with a portion 50*a* of panel 50 extending past a centerline B of the closure beneath a flap 46*a* of panel 46. A high frequency vibration sealing apparatus such as the one disclosed by U.S. Pat. No. 3,912,576 or a conventional heat sealing apparatus is utilized to seal the end closure whose various portions have one, two, three and four layers of the carton material respectively indicated by letters a, b, c and d. It should also be noted that the bottom end closure 28 may also be of the "nontuck in" type wherein the panel 50 terminates at the centerline B of this closure.

Slant top end closure 26 is formed from the container blank 20 shown in FIG. 1 after construction thereof into the tubular configuration described above and after formation of the bottom end closure 28 and filling of the partially constructed container with its contents. Roof 30 of the top end closure includes a rectangular outer roof panel 52 connected to the body portion side panel 34, a front triangular gable panel 54 connected to the body portion front panel 36, an outer roof panel 56 connected to the body portion side panel 38, and a back triangular gable panel 58 connected to the body portion back panel 40. Triangular inner roof panels 53 and 55 respectively connect the front triangular gable panel 54 with pouring spout portions 52*a* and 56*a* of the outer roof panels. Likewise, triangular inner roof panels 57 and 59 of the constructed container respectively connect the back triangular gable panel 58 with the outer roof panels 56 and 52, the latter connection being made by an upper portion 42*b* of the seam flap which is bonded to panel 59.

Slant top seal 32 of top end closure 26 includes a rectangular outer seal lip 60 shown in FIG. 1 as projecting from the outer roof panel 52 and connected thereto by a single score or score line 61. A front inner seal lip 62 is connected by a single score or score line 63 to the inner roof panels 53 and 55 that are connected to the front triangular gable panel 54. An outer seal lip 64 of the slant top seal projects from the outer roof panel 56 and is connected thereto by a single score or score line 65. A back inner seal lip 66 is connected by a single score or score line 67 to the inner roof panels 57 and 59 that are connected to the back triangular gable panel 58. Ends of the inner and outer seal lips are also connected to each other as shown and score lines 61, 63, 65, and 67 form a straight line.

Figure 6:
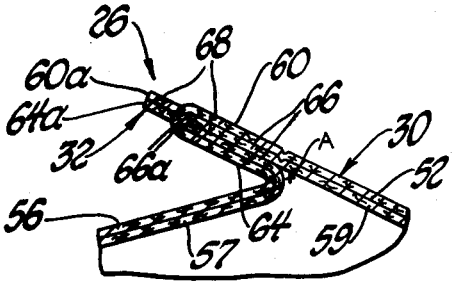
FIGS. 6 and 7 are sectional views through the top seal of the end closure and are respectively taken along lines 6—6 and 7—7 of FIG. 5.
Figure 7:
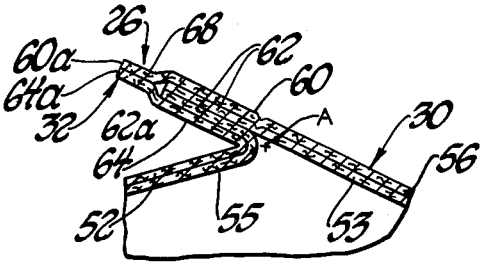
Figure 8:
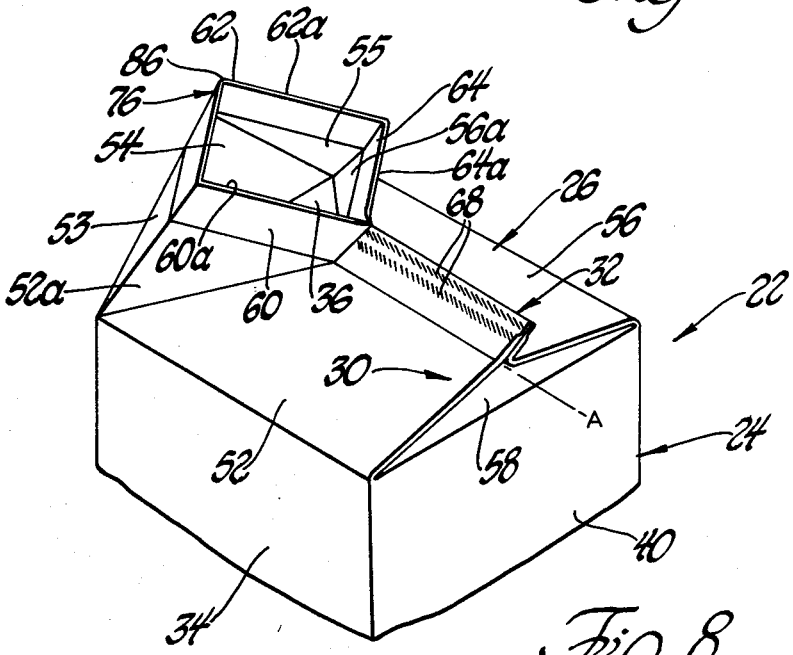
FIG. 8 is a perspective view of the top end closure of the container shown in FIG. 2 with the closure in an opened condition providing a pouring spout for dispensing the container contents.

Construction of the slant top end closure 26 begins by inward folding of the triangular gable panels 54 and 58 shown in FIG. 1 toward each other with the container blank in its tubular configuration. This folding moves the inner roof panels 53, 55 and 57, 59 respectively connected to gable panels 54 and 58 in an overlying relationship thereto and pulls the outer roof panels 52 and 56 downwardly into their inclined orientation so as to cooperatively provide the roof ridge A (FIG. 2) from which the slant top seal 32 projects at its inclined orientation. Bonds 68 best shown in FIGS. 3 and 8 along seal 32 are formed by application of either heat or high frequency vibration together with a clamping action that seals the contents of the container. Each bond 68, as seen by additional reference to FIG. 6, not only seals the outer seal lips 60 and 64 to each other but also secures the outer seal lips to the folded inner seal lip 66 therebetween which is connected to the back triangular gable panel 58 shown in FIG. 1 by the inner roof panels 57 and 59. Outer seal lips 60 and 64 are also secured to each other as shown in FIG. 7 by the one bond 68 but are prevented from forming a complete seal with the inner seal lip 62 associated with the front triangular gable panel 54 shown in FIG. 1 by coating of an abhesive material applied to the inner seal lip 62 as shown at 70 and to the outer seal lips 60 and 64 as shown at 72 and 74. This abhesive coating may be made of any suitable material, such as a wax based material, and permits the sealed top end closure 26 to be opened from its closed condition of FIG. 5 to its open condition of FIG. 6 where a pouring spout indicated by 76 is provided. Front gable panel 54 and its connected inner roof panels 53 and 55 cooperate with the spout portions 52*a* and 56*a* of outer roof panels 52 and 56 as well as with the front portions of the outer seal lips 60 and 64 and the front inner seal lip 62 to provide the pouring spout that is used to dispense the contents of the container.

Outer seal lips 60 and 64 as seen in FIG. 1 have respective straight outer terminal edges 60*a* and 64*a*. Outer seal lip 60 has a greater height projecting from its associated outer roof panel 52 to its terminal edge 60*a* than the height of outer seal lip 64 projecting from its associated outer roof panel 56 to its terminal edge 64*a*. Both outer roof panels 52 and 56 have the same height projecting from their associated body portion side panels 34 and 38 and the scores that interconnect these panels are located slightly above the scores that connect the triangular gable panels 54 and 58 with the front and back panels 36 and 40 to enhance foldability. The combined height of panel 56 and seal lip 64 is thus shorter than the combined height of panel 52 and seal lip 60 so both of these outer seal lips can project at the inclined orientation as shown in FIG. 2 while terminating adjacent each other without the lower lip 64 projecting beyond the upper lip 60 so as to form any upwardly exposed groove.

Formation of the slant top end closure 26 is facilitated by the configuration of the triangular front and back gable panels 54 and 58 shown in FIG. 1. Inclined edges 78 and 79 of gable panel 54 respectively define angles 54*a* and 54*b* with the body portion front panel 36 while intersecting with each other at an upper intersection or apex 80. Likewise, triangular gable panel 58 has inclined edges 82 and 83 that respectively define angles 58*a* and 58*b* with the body portion back panel 40 while intersecting at an upper intersection or apex 84. Inclined edge angles 54*a* and 58*a* are located on the opposite side of the roof ridge A from the direction in which the top slant seal 32 projects laterally and have a slightly smaller size than the angles 54*b* and 58*b* on the opposite side of the seal. Preferably, angle 54*a* and 58*a* have a size of approximately 46° and angles 54*b* and 58*b* have a size of approximately 47°. Thus, the triangular inner roof panels 55 and 57 toward which the slant top seal 32 projects are smaller than the inner roof panels 53 and 59 on the other side of the roof ridge axis A. This difference in size enhances the foldability of the top end closure and its ability to be sealed with the slant top seal 32 projecting at its inclined orientation which is preferably between approximately 15° and 45° relative to the horizontal.

As seen in FIG. 1, inner seal lips 62 and 66 include respective terminal edges 62*a* and 66*a* that have somewhat blunt V shapes forming associated vertices 86 and 88. Opposite ends 90 and 92 of inner seal lip 62 are respectively connected to the outer seal lips 60 and 64 adjacent their coatings of abhesive material indicated by 72 and 74. Likewise, opposite ends 94 and 96 of inner seal lip 66 are respectively connected to outer seal lip 64 and outer seal lip 60, the latter connection being at the top seam flap end 42*b*. Intermediate its ends, inner seal lip 62 includes a score or score line 98 extending between its terminal edge vertex 86 and the adjacent front gable panel inclined edge intersection or apex 80. Likewise, inner seal lip 66 includes a score or score line 100 extending between its terminal edge vertex 88 and the adjacent back gable panel inclined edge intersection 84. During sealing of the slant top seal 32, the inner seal lips fold along their respective score lines 98 and 100 so as to be located between the outer seal lips 60 and 64 as shown in FIGS. 6 and 7. End 90 of the inner seal lip 62 projects from its associated inner roof panel 53 a slightly greater distance than end 92 of this inner seal lip projects from its associated inner roof panel 55. Similarly, end 96 of inner seal lip 66 projects from its associated inner roof panel 59 a slightly greater distance than end 94 of this inner seal lip projects from its associated roof panel 57. Inner seal lip terminal edges 62*a* and 66*a* thus have unsymmetrical V shapes about their associated vertices 86 and 88 due to the different heights of their ends and their score lines 98 and 100 are uncentered between their ends due to the differences between the gable inclined edge angles 54*a*, 58*a* and 54*b*, 58*b*. During folding of the slant top end closure 26 and formation of the seal cross section shown in FIGS. 6 and 7, the different heights of the inner seal lip ends causes the folded terminal edges of each inner seal lip to have edge portions that terminate adjacent each other to form a uniform space inward from the outer bond 68 in a manner that mitigates leakage of the seal in its inclined orientation. It should also be noted in FIG. 1 that the abhesive material coatings 70, 72 and 74 terminate short of the front inner seal lip ends 90 and 92 to ensure the formation of a liquid tight seal.

Containers like the container 22 shown by FIGS. 1 through 8 can be packed in layers on top of each other to minimize the storage and cargo space necessary. As the containers are stacked, their slant top seals 32 will deflect downwardly as shown in FIG. 2 from their solid line position to the lower position shown by phantom line. As this deflection takes place, the slant top end closure 26 provides an inherent cushioning effect between the layers of containers to enhance the transportability of the containers without leakage occurring. Unlike folded gable roof closures with vertically projecting seals, this container does not require any shipping tray intermediate the different layers of stacked containers. No releasable securement of the slant top seal to the rest of the top end closure is necessary as with flat top end closures.

FIGS. 9 through 13 are partial views similar to FIG. 1 of different container blank embodiments according to the present invention. Each of these container blank embodiments has corresponding panels and portions thereof the same as the container blank previously discussed and as such like reference numerals are applied thereto except as is hereinafter noted. The foregoing description of the container shown by FIGS. 1 through 8 is thus applicable to containers made by the modified blanks.

Figure 9:
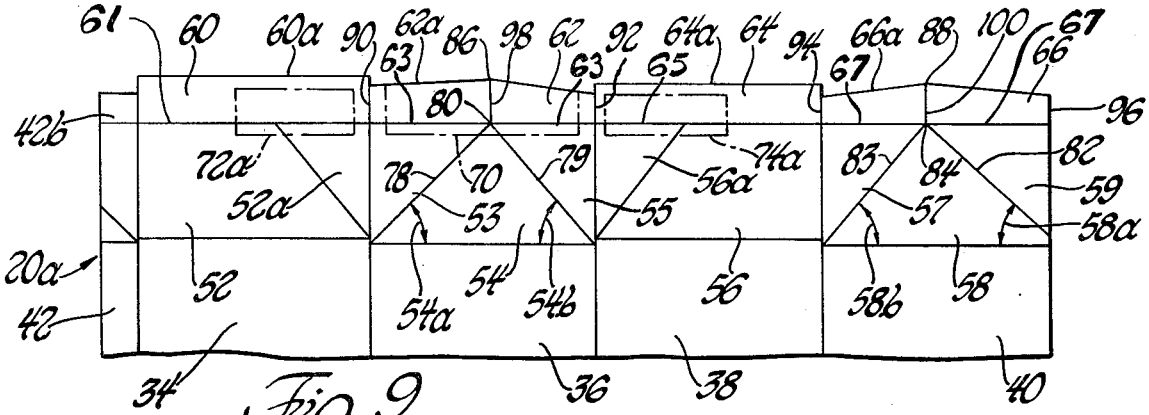
FIG. 9 is a partial view of a container blank similar to the one of FIG. 1 but having a slightly different abhesive coating pattern represented by phantom line illustration.

Container blank 20*a* shown in FIG. 9 is made from a paperboard blank construction the same as the container blank 20 shown in FIG. 1 but has a different pattern of abhesive coating applied to its outer seal lips 60 and 64. Abhesive coating 70 applied to the inner seal lip 62 is the same as with the previously described embodiment but the coatings 72*a* and 74*a* applied to the outer seal lips extend past the location of the inner seal lip score 98 where folding thereof occurs. The increased length of adhesive material 72*a* and 74*a* makes the pouring spout of a container constructed from this blank slightly easier to open.

Figure 10:
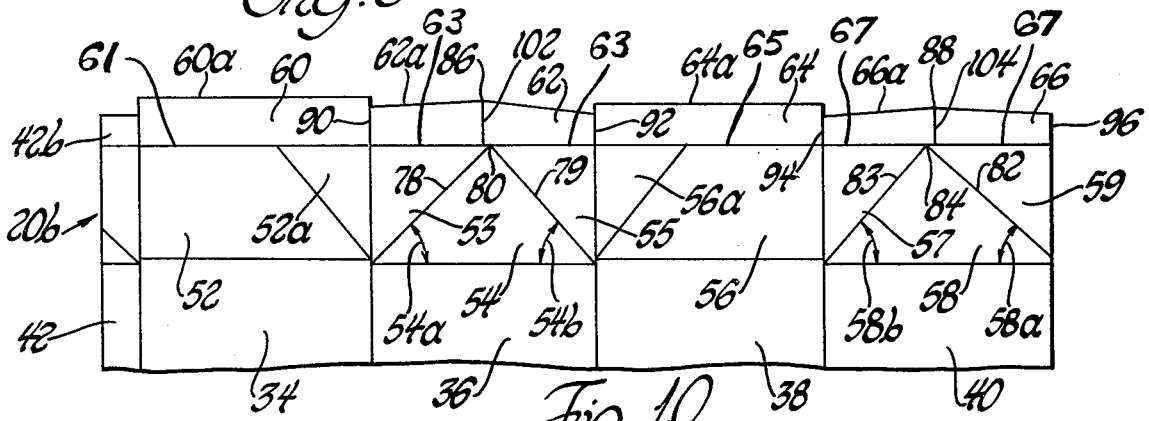
FIG. 10 is a partial view of a container blank similar to the one of FIG. 1 but having inner seal lips with scores that are centered midway between opposite ends of the inner seal lips.
Figure 11:
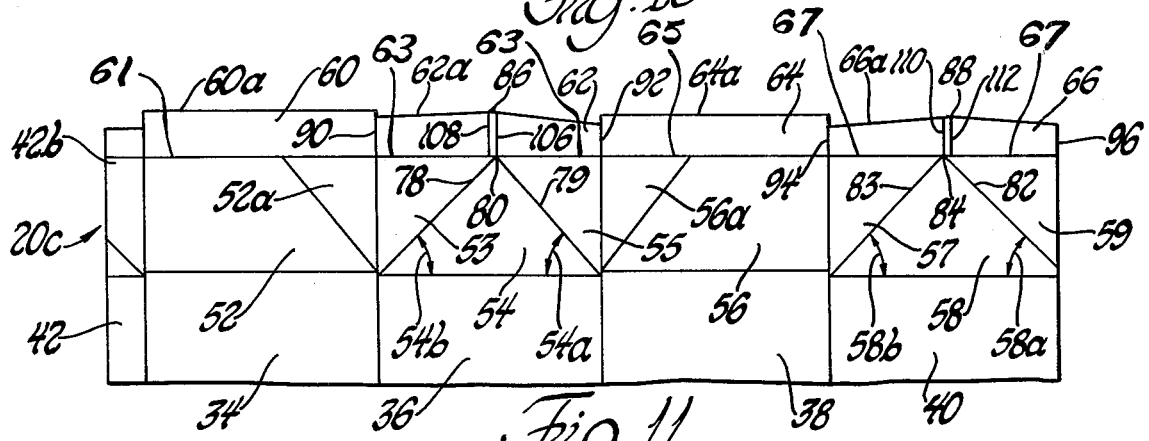
FIG. 11 is a partial view similar to FIG. 1 of a container blank whose inner seal lips have pairs of scores, one of the scores being located like the embodiment of FIG. 1 and the other score being located like the embodiment of FIG. 10.
Figure 12:
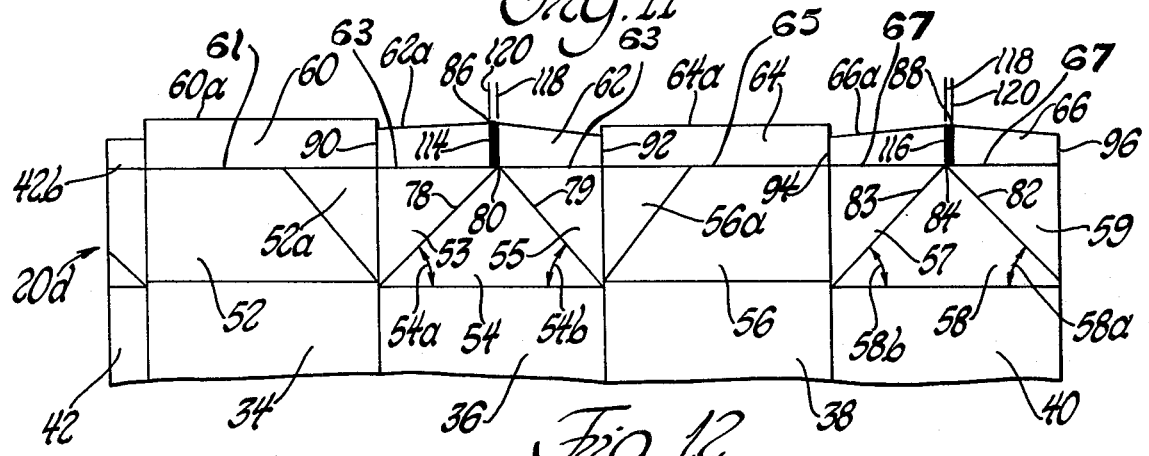
FIG. 12 is a partial view similar to FIG. 1 of another container blank embodiment whose inner seal lips incorporate relatively wide scores.

Each container blank embodiment shown by FIGS. 10 through 12 has a slightly modified construction that is particularly adaptable for making relatively large size containers. As previously mentioned, the inner seal lip scores 98 and 100 are not centered between their associated inner seal lip ends due to the angular differences between the gable panel inclined edge angles 54*a*, 58*a* and 54*b*, 58*b*. With relatively small size containers of the pint and half-pint size or so, this noncentered relationship is not of a great significance in folding the inner seal lips to provide the slant top seal. However, as the containers become of a larger size like quart, half-gallon and gallon containers, the noncentered relationship of the inner seal lip scores becomes more significant. Each of these last three embodiments accommodates for this effect in a different way. Also, it should be noted that the abhesive coating pattern of either the FIG. 1 embodiment or the FIG. 9 embodiment may be used with the embodiments of FIGS. 10 through 12 as well as with the embodiment of FIG. 13.

As seen in FIG. 10, the container blank 20*b* has its inner seal lips 62 and 66 provided with respective scores or score lines 102 and 104 that extend from their associated terminal edge vertices 86 and 88 to the adjacent inner roof panels 53 and 59 just to the left and right of the gable inclined edge intersections 80 and 84, respectively. These scores 102 and 104 are centered midway between the opposite ends 90, 92 and 94, 96 of the inner seal lips. During folding to form the slant top seal of this invention, the inner seal lips fold at their center scores. Deformation of the coated paperboard blank material adjacent the gable inclined edge intersections 80 and 84 accommodates for the spaced relationship of the scores 102 and 104 relative to these intersections.

In FIG. 11, the container blank 20*c* has its inner seal lip 62 provided with a pair of scores or score lines 106 and 108 and has its inner seal lip 66 provided with a pair of scores or score lines 110 and 112. Score 106 of inner seal lip 62 intersects with the front gable inclined edge intersection 80. Score 108 is spaced from the score 106 in a parallel relationship extending from the terminal edge vertex 86 to the adjacent inner roof panel 53 at a location midway between the inner seal lip ends 90 and 92. Likewise, score 110 of inner seal lip 60 intersects with the adjacent back gable inclined edge intersection 84 while score 112 extends from the associated terminal edge vertex 88 to the adjacent inner roof panel 59 in a parallel relationship to score 110 at a location midway between the inner seal lip ends 94 and 96. During folding of container blank 20*c* to form a slant top seal according to this invention, scores 108 and 112 of the inner seal lips provide a center location for folding midway between the opposite ends thereof while scores 106 and 110 are aligned with the gable inclined edge intersections to accommodate for folding of the seal lips relative to the gable panels 54 and 58 as the slant top seal assumes its inclined orientation.

In FIG. 12, the container blank embodiment 20*d* has its inner seal lips 62 and 66 respectively provided with relatively wide scores or score lines 114 and 116. Each score 114 and 116 has a width that extends between a pair of parallel lines 118 and 120. Lines 118 extend along the inner seal lips 62 and 66 to the associated gable inclined edge intersections 80 and 84. Lines 120 are centered midway between the ends 90, 92 and 94, 96 of seal lips 62 and 66 and extend through the inner seal lip terminal edge vertices 86 and 88. During formation of the slant top seal as blank 20*d* is constructed, the width of scores 114 and 116 accommodates for the difference between the centers of the inner seal lips and the adjacent gable inclined edge intersections.

Figure 13:
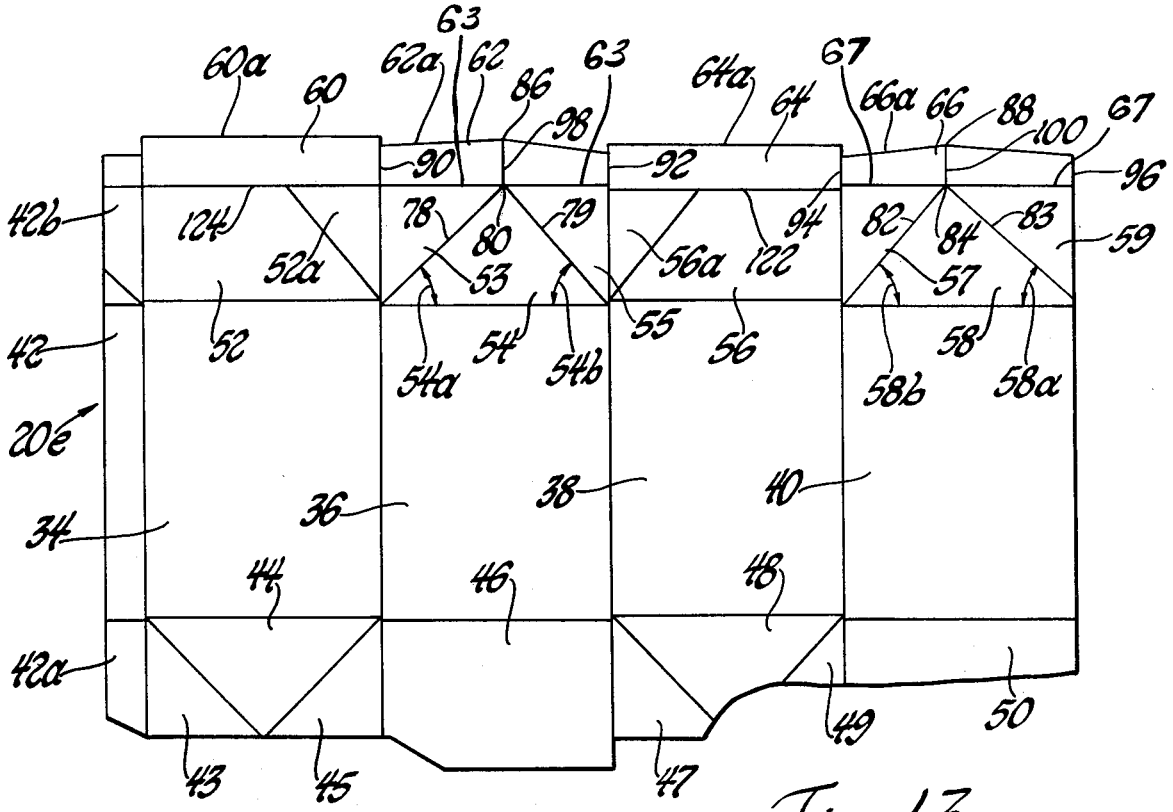
FIG. 13 is a partial view similar to FIG. 1 of another container blank embodiment having outer roof panels of different heights.
Figure 14:
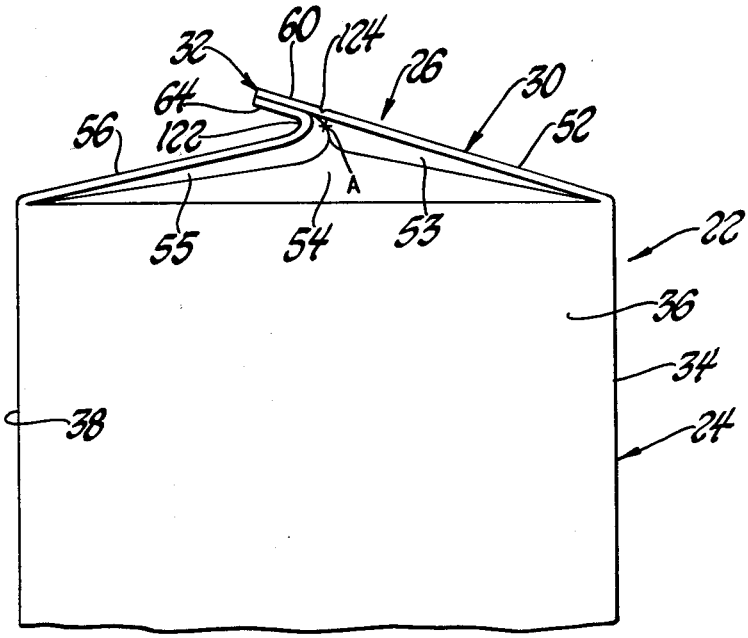
FIG. 14 is an enlarged partial view of the constructed container blank shown in FIG. 13.

Container blank 20*e* shown in FIG. 13 has the same construction as the blank of FIG. 1 except for its outer roof panel 56 and outer seal lip 64. While the combined heights of panel 56 and lip 64 is less than the combined height of panel 52 and lip 60, panel 56 also has a shorter height than panel 52. The score or score line 122 that interconnects outer roof panel 56 and outer seal lip 64 is thus dropped or lower than the apices 80 and 84 of the gable panel edges. Score 122 is thus also dropped or lower than the single score or score line 124 that interconnects outer roof panel 52 and outer seal lip 60. This construction enhances the foldability of the container slant top seal. Thus, the score positioning helps in folding the slant top seal 32 into its inclined position of FIG. 14 projecting toward the smaller inner roof panels 55 and 57 prior to sealing thereof to provide a liquid tight seal.

Figure 15:
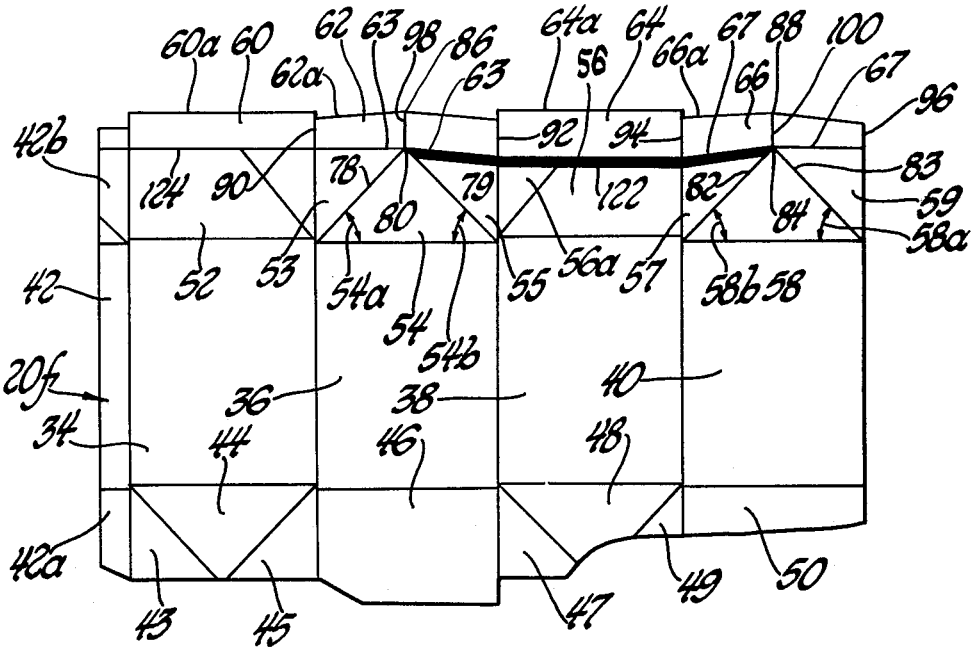
FIG. 15 is a partial view showing another preferred embodiment of a blank for constructing a container in accordance with the present invention.

Referring to FIG. 15, another embodiment of a thermoplastic coated paperboard blank for constructing a container in accordance with this invention is indicated by reference numeral **20*f* and has numerals corresponding to the previously described embodiments indicating like components and portions thereof since much of the previous description is applicable to this embodiment except as will be noted. Container blank 20*f* like container blank 20*e* has a single score or score line 122 that connects the outer roof panel 56 and outer seal lip 64 at a dropped or lower elevation than the gable apices 80 and 84 and the single score line 124 that connects outer roof panel 52 and outer seal lip 60. The combined height of outer roof panel 52 and outer seal lip 60 is the same as the combined height of outer roof panel 56 and outer seal lip 64. Score line 122 that connects the outer roof panel 56 and the outer seal lip 64 is wider than the score line 124 that connects outer roof panel 52 and outer seal lip 60 in order to facilitate folding of the top seal after construction of the container as will be more fully hereinafter described. Each of the front and back gable panels 54 and 58 of blank 20*f* shown in FIG. 15 has its base angles 54*a*, 54*b*, and 58*a*, 58*b* equal to each other. As such, the intersection or apices 80 and 84 of the gable panels where the intersecting edges 78, 79 and 82, 83 meet are located centrally between the opposite ends 90, 92 and 94, 96 of the inner seal lips 62 and 66. Each single score line 63 and 67 that connects the associated inner seal lip 62 or 66 with the adjacent inner roof panels 53, 55, or 57, 59 includes an inclined portion whose upper end extends to the adjacent gable apex 80 or 84 and whose lower end is connected to the adjacent end of the score line 122. The inclined score line portions 63 and 67 like the score line 122 are wider than the other score lines so as to also facilitate the folding of the top seal from a vertical position as is more fully hereinafter described. It should also be noted that the terminal edges 62*a* and 66*a* of the inner seal lips 62 and 66 are of a symmetrical but quite blunt V shape on opposite sides of their central vertices 86 and 88** in this embodiment.

Figure 16:
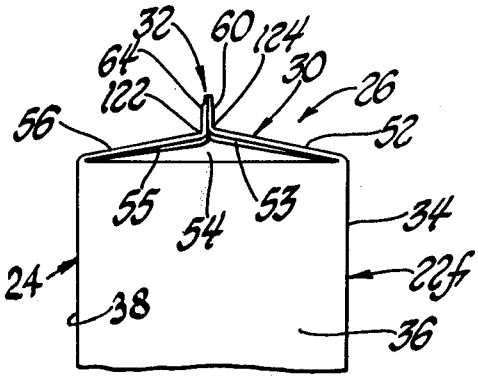
FIG. 16 is a partial view of a container constructed from the blank of FIG. 15 and shows the top seal of the top end closure in a vertical position where sealing thereof is performed.

Blank **20*f* of FIG. 15 is constructed into a container 22*f* as shown in FIG. 16 generally in the same manner as described with the previous embodiment of FIGS. 1 through 8 with one exception. Top seal 32 that closes the roof 30 of the constructed container is sealed in the vertically extending position shown in FIG. 16 as opposed to a slant or inclined position as with the previously described embodiments. The wider score line 122 is located below the score line 124 on the opposite side of the seal and the wider and inclined portion of score lines 63 and 67 extend generally parallel to the score line 122. The terminal edges of the outer seal lips 60 and 64 extend alongside each other as do the folded terminal edge portions of the inner seal lips in the same manner described in connection with the previous embodiments. It should also be noted that the abhesive coating pattern of either FIGS. 1 or 9** can be utilized to provide opening of the container to define a pouring spout in the same manner previously described.

Figure 17:
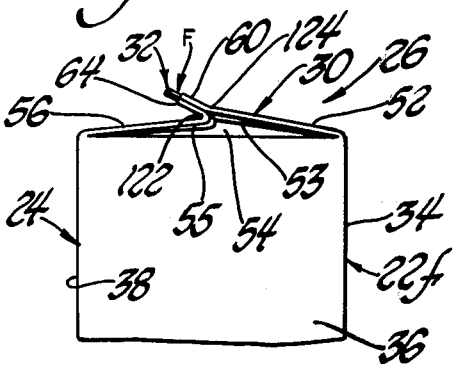
FIG. 17 is a view of the container after the top seal has been bent from the vertical position of FIG. 16 to the inclined position shown in order to provide a slant top seal for the top end closure.

Constructed container **22*f* can be utilized with its top seal 32 extending vertically as shown in FIG. 16 and then functions generally in the same manner as the conventional straight up vertical gable top. It is also possible to fold the top seal 32 to an inclined position by the application of a force F as shown in FIG. 17 in order to provide a slant top seal. Folding of the top seal 32 to the slant top position shown in FIG. 17 is facilitated by the wider and dropped score line 122 and the wider and inclined portions of score lines 63 and 67. In the slant top condition, the top seal 32 extends toward the smaller inner roof panels 55 and 57 which are partially defined by the inclined score line portions of score lines 63 and 67. In use, the slant top version of container 22*f* shown in FIG. 17** functions in a manner similar to the previously described slant top containers.

Figure 18:
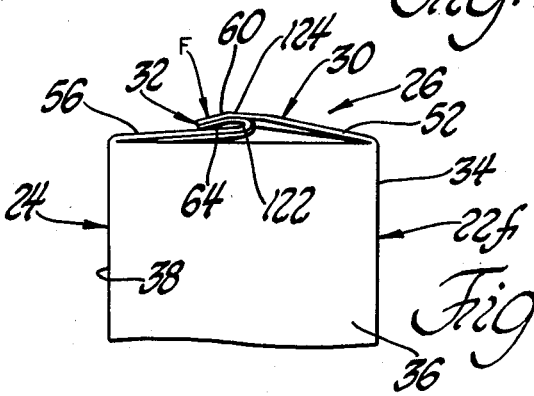
FIG. 18 is a view of the container after the top seal has been bent from the vertical position of FIG. 16 to the flat position shown and releasably secured in order to provide a flat top seal for the top end clsoure.

The versatility of the container blank **20*f* shown in FIG. 15 is further demonstrated by FIG. 18 wherein the top seal 32 is shown folded over to a horizontal position in order to provide a flat top end closure. Force F which bends the top seal 32 by use of a suitable tool toward the side of the container on which the dropped and wide score line 122 is located. The outer seal lip 64 is then releasably secured to the outer roof panel 56 by a suitable adhesive bond provided in any conventional manner in order to provide the flat top closure. Opening of the constructed flat top end closure of container 22*f* thus proceeds by first releasing the top seal 32 from the outer roof panel 56 and then moving the top seal to either the slant position of FIG. 17 or the vertical position of FIG. 16** followed by opening of the pouring spout in the same manner previously described in connection with the other embodiments.

While the best mode for practicing the present invention has herein been disclosed in detail, those skilled in the art will recognize various alternative designs and embodiments for practicing the present invention as defined by the following claims.

What is claimed is:

1. In a coated paperboard container including a body portion having top and bottom ends and constructed from a pair of side panels and a front panel connecting the side panels as well as a back panel connected to one of the side panels, and a bottom end closure including folded panels connected to the panels of the body portion at the bottom end thereof, a slant top end closure comprising the combination of: a folded gable roof connected to the panels of the body portion at the top end thereof; a slant top seal for sealing the roof while projecting upwardly and laterally therefrom at an inclined angle so as to be deflectable to permit stacking thereof in a manner that lessens the required storage space; said roof including outer roof panels connected to the side panels extending at inclined orientations therefrom to cooperatively define an upper ridge from which the slant top seal projects; the roof also including front and back triangular gable panels connected to the front and back panels of the body portion and having triangular inner roof panels connecting the gable panels with the outer roof panels; the gable panels including intersecting inclined edges extending from the front and back panels with the angles defined therewith just slightly greater for the inclined edges adjacent the side panel toward which the slant top seal projects than for the inclined edges adjacent the other side panel; the roof outer panels including triangular spout portions adjacent the front panel so as to cooperate with the front gable panel and the inner roof panels connected thereto to provide a pouring spout; said slant top seal including outer seal lips sealed to each other respectively projecting from the outer roof panels and also including folded front and back inner seal lips projecting from the inner roof panels between the outer seal lips respectively above the front and back gable panels; said outer seal lips including straight terminal edges spaced from their associated outer roof panels; one outer seal lip and the outer roof panel connected thereto on the side of the roof ridge toward which the slant top seal projects having a combined height that projects from the associated body portion side panel a shorter distance than the other outer seal lip and outer roof panel on the opposite side of the roof ridge so that said one outer seal lip does not project beyond the straight terminal edge of the other outer seal lip; said inner seal lips including unsymmetrical V-shaped terminal edges having respective vertices and terminating short of the straight terminal edges on the outer seal lips extending generally parallel therewith; the inner seal lips also including opposite ends connected to the outer seal lips; and each inner seal lip having the end thereof connected to said one outer seal lip projecting from the associated inner roof panel a shorter distance than the other end thereof connected to the other outer seal lip so that the slant top seal has a cross section along the roof ridge including folded inner seal lip edge portions that terminate adjacent each other in the inclined orientation thereof to lessen the likelihood of leakage occurring along the seal.

2. A container as claimed in claim 1 wherein the front inner seal lip includes a score that extends to the vertex of the V-shaped terminal edge thereof from the intersection between the inclined edges of the front triangular gable panel.

3. A container as claimed in claim 2 wherein the back inner seal lip includes a score that extends to the vertex of the V-shaped terminal edge thereof from the intersection between the inclined edges of the back triangular gable panel.

4. A container as claimed in claim 1 wherein the front inner seal lip includes a score that extends to the terminal edge thereof from the inner roof panel which is connected thereto and is located on the opposite side of the roof ridge from the direction in which the slant top seal projects, and said score being located at the midpoint between the ends of the front inner seal lip in a spaced relationship to the intersection between the inclined edges of the front triangular gable panel.

5. A container as claimed in claim 4 wherein the back inner seal lip includes a score that extends to the terminal edge thereof from the inner roof panel which is connected thereto and located on the opposite side of the roof ridge from the direction in which the slant top seal projects, and said score of the back inner seal lip being located at the midpoint between the ends of the back inner seal lip in a spaced relationship to the intersection between the inclined edges of the back triangular gable panel.

6. A container as claimed in claim 1 wherein the front inner seal lip located adjacent the front panel of the body portion includes a pair of spaced scores that extend to the terminal edge thereof, one of said spaced scores intersecting with the intersection between the inclined edges of the front triangular gable panel, and the other of said spaced scores being located at the midpoint between the ends of the front inner seal lip extending from the front inner seal lip terminal edge vertex to the inner roof panel that is connected to the front inner seal lip on the opposite side of the roof ridge from the direction in which the slant top seal projects.

7. A container as claimed in claim 6 wherein the back inner seal lip includes a pair of spaced scores that extend to the terminal edge thereof, one of said scores of the back inner seal lip intersecting with the intersection between the inclined edges of the back triangular gable panel, and the other score of the back inner seal lip being located at the midpoint between the ends thereof extending from the back inner seal lip terminal edge vertex to the inner roof panel that is connected to the back inner seal lip on the opposite side of the roof ridge from the direction in which the slant top seal projects.

8. A container as claimed in claim 1 wherein the front inner seal lip includes a wide score that extends to the V-shaped terminal edge thereof, and said wide score having a width that extends between the midpoint of the front inner seal lip intermediate its ends and a line that intersects with the intersection of the inclined edges on the front triangular gable panel.

9. A container as claimed in claim 8 wherein the back inner seal lip includes a wide score that extends to the V-shaped terminal edge thereof, and said wide score of the back inner seal lip having a width that extends between the midpoint of the back inner seal lip intermediate its ends and a line that intersects with the intersection of the inclined edges on the back triangular gable panel.

10. A container as claimed in claim 1 wherein the outer roof panels on both sides of the roof ridge project from their associated body portion side panels the same distance, said one outer seal lip on the side of the roof ridge toward which the seal projects having a shorter height projecting from the outer roof panel connected thereto than the other outer seal lip on the opposite side of the roof ridge.

11. A container as claimed in claim 1 wherein the outer roof panel on the side of the roof ridge toward which the slant top seal extends has a shorter height projecting from its associated body portion side panel than the other outer roof panel on the opposite side of the roof ridge.

12. In a coated paperboard container including a body portion having top and bottom ends and constructed from a pair of side panels and a front panel connecting the side panels as well as a back panel connected to one of the side panels, and a bottom end closure including folded panels connected to the panels of the body portion at the lower end thereof, a slant top end closure comprising the combination of: a folded gable roof connected to the panels of the body portion at the top end thereof; a slant top seal for sealing the roof while projecting upwardly and laterally therefrom at an inclined angle so as to be deflectable to permit stacking thereof in a manner that lessens the required storage space; said roof including outer roof panels connected to the side panels extending at inclined orientations therefrom to cooperatively define an upper ridge from which the slant top seal projects; the roof also including front and back triangular gable panels connected to the front and back panels of the body portion and having triangular inner roof panels connecting the gable panels with the outer roof panels; the gable panels including intersecting inclined edges extending from the front and back body portion panels with the angles defined therewith just slightly greater for the inclined edges adjacent the side panel toward which the slant top seal projects than for the inclined edges adjacent the other side panel; the roof outer panels including triangular spout portions adjacent the front panel so as to cooperate with the front gable panel and the inner roof panels connected thereto to provide a pouring spout; said slant top seal including outer seal lips sealed to each other respectively projecting from the outer roof panels and also including folded front and back inner seal lips projecting from the inner roof panels between the outer seal lips respectively adjacent the front and back panels of the body portions; said outer seal lips including straight terminal edges spaced from their associated outer roof panels; one outer seal lip and the outer roof panel connected thereto on the side of the roof ridge toward which the slant top seal projects having a combined height that projects from the associated body portion side panel a shorter distance than the other outer seal lip and outer roof panel on the opposite side of the roof ridge so that said one outer seal lip does not project beyond the straight terminal edge of the other outer seal lip; said inner seal lips including unsymmetrical V-shaped terminal edges having respective vertices and terminating short of the straight terminal edges on the outer seal lips extending generally parallel therewith; the inner seal lips also including opposite ends connected to the outer seal lips; each inner seal lip having the end thereof connected to said one outer seal lip projecting from the associated inner roof panel a shorter distance than the other end thereof connected to the other outer seal lip so that the slant top seal has a cross section along the roof ridge including folded inner seal lip edge portions that terminate adjacent each other in the inclined orientation thereof to lessen the likelihood of leakage occurring along the seal; a score that extends to the terminal edge of the front inner seal lip so as to provide a fold along which the pouring spout is formed; and an adhesive coating on the front inner seal lip and on the outer seal lips adjacent the front panel of the body portion so as to limit sealing between the inner and outer sealing lips to thereby facilitate opening of the pouring spout.

13. A container as claimed in claim 12 wherein the adhesive coating on each outer seal lip includes a pattern that does not overlie the score of the front inner seal lip.

14. A container as claimed in claim 12 wherein the adhesive coating on each outer seal lip includes a pattern that overlies the score of the front inner seal lip.

15. A blank for constructing a container, the blank comprising: body portion panels including front and back panels and a pair of side panels one of which connects the front and back panels; bottom end closure panels connected to lower ends of the body portion panels; top end closure panels connected to upper ends of the body portion panels; said top end closure panels including front and back gable panels respectively connected to the upper ends of the front and back panels of the body portion and also including a pair of outer roof panels respectively connected to the upper ends of the side panels of the body portion; a pair of traingular inner roof panels located on opposite sides of each gable panel; the inner roof panels of each pair being of a different size than each other; top seal lips including a pair of inner seal lips respectively connected to the inner roof panels associated with each gable panel; a single score line connecting each inner seal lip and the associated inner roof panels; said top seal lips also including a pair of outer seal lips respectively connected to the outer roof panels; a single score line connecting each outer seal lip and the associated outer roof panel; and the outer seal lips having terminal edges whose heights are selected so as to extend generally alongside each other upon construction of a top end closure and a top seal by folding of said top end closure panels and said top seal lips.

16. A blank as in claim 15 wherein each gable panel includes a pair of unequal base angles so as to provide the different size of each inner roof panel on its opposite sides.

17. A blank as in claim 15 wherein one of the outer seal lips and the associated outer roof panel have the single score line therebetween located lower than the single score line between the other outer seal lip and outer roof panel, said lower single score line being wider than the single score line between said other outer seal lip and outer roof panel, each of said single score lines between the inner seal lips and the associated inner roof panels including a wide portion and a narrow portion, said wide score line portions having inclined orientations with upper ends that intersect with apices of the associated gable panels and lower ends that are located adjacent the opposite ends of said wide score line in the constructed condition of the top end closure.

18. A blank as in claim 15 wherein the single score line between one outer seal lip and roof panel is located below the single score line between the other outer seal lip and roof panel.

19. A blank for constructing a container, the blank comprising: body portion panels including front and back panels and a pair of side panels one of which connects the front and back panels; bottom end closure panels connected to lower ends of the body portion panels; top end closure panels connected to upper ends of the body portion panels; said top end closure panels including front and back gable panels respectively connected to the upper ends of the front and back panels of the body portion and also including a pair of outer roof panels respectively connected to the upper ends of the side panels of the body portion; each of said gable panels including a pair of equal base angles and an upper apex; a pair of triangular inner roof panels located on opposite sides of each gable panel; the inner roof panels of each pair being of a different size than each other; top seal lips including a pair of inner seal lips respectively connected to the inner roof panels associated with each gable panel; a single score line connecting each inner seal lip and the associated inner roof panels; said top seal lips also including a pair of outer seal lips respectively connected to the outer roof panels; a single score line connecting each outer seal lip and the associated outer roof panel; one single score line that connects the outer seal lip and the outer roof panel connected to said one side panel of the body portion being located below the apices of the gable panels and being wider than the other single score line connecting the other outer seal lip and outer roof panel; each of the smaller inner roof panels being located adjacent one end of the wide score line; each of the single score lines connecting the inner seal lips and the associated inner roof panels including a wide score line portion connected to one end of the wide score line between the one outer seal lip and outer roof panel; and the outer seal lips having terminal edges whose heights are selected so as to extend generally alongside each other upon construction of a top end closure and a top seal by folding of said top end closure panels and said top seal lips.

20. A blank for constructing a container, the blank comprising: body portion panels including front and back panels and a pair of side panels one of which connects the front and back panels; bottom end closure panels connected to lower ends of the body portion panels; top end closure panels connected to upper ends of the body portion panels; said top end closure panels including front and back gable panels respectively connected to the upper ends of the front and back panels of the body portion and also including a pair of outer roof panels respectively connected to the upper ends of the side panels of the body portion; each of said gable panels including a pair of equal base angles and an upper apex; a pair of triangular inner roof panels located on opposite sides of each gable panel; the inner roof panels of each pair being of a different size than each other; top seal lips including a pair of inner seal lips respectively connected to the inner roof panels associated with each gable panel; a single score line connecting each inner seal lip and the associated inner roof panels; said top seal lips also including a pair of outer seal lips respectively connected to the outer roof panels; a single score line connecting each outer seal lip and the associated outer roof panel; one single score line that connects the outer seal lip and the outer roof panel connected to said one side panel being wider and located below the other single score line that connects the other outer seal lip and outer roof panel; each of the smaller inner roof panels being located adjacent one end of said lower and wider score line; each of the single score lines connecting the inner seal lips and the associated inner roof panels including an inclined score line portion that is wider than the other portion thereof and includes an upper end connected to the adjacent gable panel apex and a lower end connected to one end of said wider and lower score line; and the outer seal lips having terminal edges whose heights are selected so as to extend generally alongside each other upon construction of the top end construction.

21. A container comprising: a body portion including front and back panels and a pair of side panels which connect the front and back panels; a bottom end closure including folded panels connected to lower ends of the body portion panels; a top end closure including folded panels connected to upper ends of the body portion panels and a top seal connected to the closure panels; said top end closure panels including front and back gable panels respectively connected to the upper ends of the front and back panels of the body portion and also including a pair of outer roof panels respectively connected to the upper ends of the side panels of the body portion; a pair of triangular inner roof panels located on opposite sides of each gable panel and connected to the outer roof panels; the inner roof panels on one side of the top seal being smaller than the inner roof panels on the other side thereof; the top seal including a pair of inner seal lips respectively connected to the inner roof panels associated with each gable panel; a single score line connecting each inner seal lip and the associated inner roof panels; the top seal also including a pair of outer seal lips respectively connected to the outer roof panels; a single score line connecting each outer seal lip and the associated outer roof panel; and the outer seal lips having terminal edges whose heights are selected so as to extend generally alongside each other upon construction of the top end closure.

22. A container as in claim 21 wherein the front and back gable panels each include a pair of unequal base angles so as to provide the different size of the roof panels on opposite sides of the top seal.

23. A container as in claim 21 wherein the single score line between the outer seal lip and outer roof panel on the same side of the top seal as the smaller inner roof panels is lower and wider than the single score line between the other outer seal lip and outer roof panel on the other side of the top seal, each of said single score lines between the inner seal lips and the associated inner roof panels including a wide portion and a narrow portion, said wide score line portions having inclined orientations with upper ends that intersect with apices of the gable panels and lower ends connected to opposite ends of the lower and wider score line that connects the outer seal lip and outer roof panel on the side of the top seal where the smaller inner roof panels are located.

24. A container as in claim 21 wherein the single score line between one outer seal lip and outer roof panel is located below the single score line between the other outer seal lip and outer roof panel.

25. A container comprising: a body portion including front and back panels and a pair of side panels which connect the front and back panels; a bottom end closure including folded panels connected to lower ends of the body portion panels; a top end closure including top closure panels connected to upper ends of the body portion panels to provide a folded roof and also including a top seal including seal lips connected to the top closure panels and sealed to each other to provide the top seal; said top closure panels including front and back gable panels repectively connected to upper ends of the front and back panels of the body portion and also including a pair of outer roof panels respectively connected to the upper ends of the side panels of the body portion on opposite sides of the top seal; each of said gable panels including a pair of equal base angles and an apex; a pair of triangular inner roof panels flanking each gable panel; the inner roof panels on one side of the top seal being of a smaller size than the inner roof panels on the other side thereof; said top seal including a pair of inner seal lips respectively connected to the inner roof panels associated with each gable panel; a single score line connecting each inner seal lip and the associated inner roof panels; said top seal also including a pair of outer seal lips respectively connected to the outer roof panels; a single score line connecting each outer seal lip and the associated outer roof panel; the single score line connecting the outer seal lip and roof panel on the same side of the top seal as the smaller inner roof panels being lower than the apices of the gable panels and wider than the single score line connecting the outer seal lip and outer roof panel on the side of the top seal where the larger inner roof panels are located; each of the single score lines connecting the inner seal lips and the associated inner roof panels including a wider score line portion connected to one end of the wide score line between the outer seal lip and outer roof panel on the side of the top seal where the smaller inner roof panels are located; and the outer seal lips having terminal edges that extend generally alongside each other.

26. A container comprising: a body portion including front and back panels and a pair of side panels which connect the front and back panels; a bottom end closure including folded panels connected to lower ends of the body portion panels; a top end closure including top closure panels connected to upper ends of the body portion panels to provide a folded roof and also including a top seal including seal lips connected to the top closure panels and sealed to each other to provide a top seal; said top closure panels including front and back gable panels respectively connected to upper ends of the front and back panels of the body portion and also including a pair of outer roof panels respectively connected to the upper ends of the side panels of the body portion on opposite sides of the top seal; each of said gable panels including a pair of equal base angles and an apex; a pair of triangular inner roof panels flanking each gable panel; the inner roof panels on one side of the top seal being of a smaller size than the inner roof panels on the other side thereof; said top seal including a pair of inner seal lips respectively connected to the inner roof panels associated with each each gable panel; a single score line connecting each inner seal lip and the associated inner roof panels; said top seal also including a pair of outer seal lips respectively connected to the outer roof panels; the single score line connecting the outer seal lip and roof panel on the same side of the top seal as the smaller inner roof panels being lower and wider than the single score line connecting the outer seal lip and outer roof panel on the other side of the top seal; each of said single score lines connecting the inner seal lips and the associated inner roof panels including a wide score line portion that connects each smaller inner roof panel and the associated inner seal lip; each of said wide score line portions having an inclined orientation and including an upper end connected to the adjacent gable panel apex and a lower end connected to one end of the wide score line between the outer seal lip and outer roof panel on the side of the top seal where the smaller inner roof panels are located; a single score line connecting each outer seal lip and the associated outer roof panel; and the outer seal lips having terminal edges that extend generally alongside each other.

* * * * *